United States Patent [19]

Waryasz

[11] 4,453,494

[45] Jun. 12, 1984

[54] FLUIDIZED BED BOILER HAVING A SEGMENTED GRATE

[75] Inventor: Richard E. Waryasz, Longmeadow, Mass.

[73] Assignee: Combustion Engineering, Inc., Windsor, Conn.

[21] Appl. No.: 360,154

[22] Filed: Mar. 22, 1982

[51] Int. Cl.[3] ..... F22B 1/00

[52] U.S. Cl. ..... 122/4 D; 110/234; 110/245; 110/263

[58] Field of Search ..... 122/4 D, 459; 110/245, 110/263; 431/7, 170; 165/104.16

[56] References Cited

U.S. PATENT DOCUMENTS

| | | | |
|---|---|---|---|
| 3,712,369 | 1/1973 | Berlin et al. | 122/4 D |
| 3,760,776 | 9/1973 | Durrant | 122/459 |
| 3,863,606 | 2/1975 | Bryers et al. | 122/4 D |
| 3,881,857 | 5/1975 | Hoy et al. | 110/263 |
| 3,905,336 | 9/1975 | Gamble et al. | 422/198 |
| 4,183,330 | 1/1980 | Bryers et al. | 110/245 |
| 4,211,186 | 7/1980 | Pearce | 431/170 |

*Primary Examiner*—Edward G. Favors
*Assistant Examiner*—Steven E. Warner
*Attorney, Agent, or Firm*—Robert L. Olson

[57] ABSTRACT

A fluidized bed furnace (10) is provided having a perforate grate (9) within a housing which supports a bed of particulate material including some combustibles. The grate is divided into a plurality of segments (E2–E6, SH1–SH5, RH1–RH5), with the airflow to each segment being independently controlled. Some of the segments have evaporating surface imbedded in the particulate material above them, while other segments are below superheater surface or reheater surface. Some of the segments (E1, E7) have no surface above them, and there are ignitor combustors (32, 34) directed to fire into the segments, for fast startup of the furnace without causing damage to any heating surface.

1 Claim, 6 Drawing Figures

FLUIDIZED BED BOILER HAVING A SEGMENTED GRATE

The Government of the United States of America has rights in this invention pursuant to Contract Number EX-76-C-01-2473 awarded by the U.S. Department of Energy.

BACKGROUND OF THE INVENTION

One present means of burning coal cleanly is in a fluidized bed boiler. The coal is burned in a bed of inert material while in a fluidized state, and the heat generated is used to generate and superheat steam, which can be used for producing electricity. Although this is a good means of burning coal cleanly, it does have some other problems. One of the problems is the startup of such a unit, especially with large size units. Coal is difficult to burn in a fluidized bed until the bed of material is raised to a relatively high temperature. Also, care must be taken to protect the heat exchange surface positioned within the bed during startup.

SUMMARY OF THE INVENTION

In accordance with the invention, a fluidized bed boiler is provided which can be started up efficiently and with relative ease, while protecting the heat exchange surface. The bed is made up of a plurality of modules, some of which contain evaporating surface, others containing superheater surface, and still others containing reheater surface. The fluidizing air system is also compartmented, so that the air flow to each module can be independently controlled. Heaters are located in the air duct to initially heat the air. Two startup burners are also located in two of the beds, to establish the initial combustion. The two modules that are initially fired do not contain any heat exchange surface, so that they can be brought up to ignition temperature as rapidly as possible. There are no imperforate walls between the modules, so that the number of drains for discharge of ash can be kept to a minimum.

DESCRIPTION OF THE PREFERRED EMBODIMENT

Figure 1:
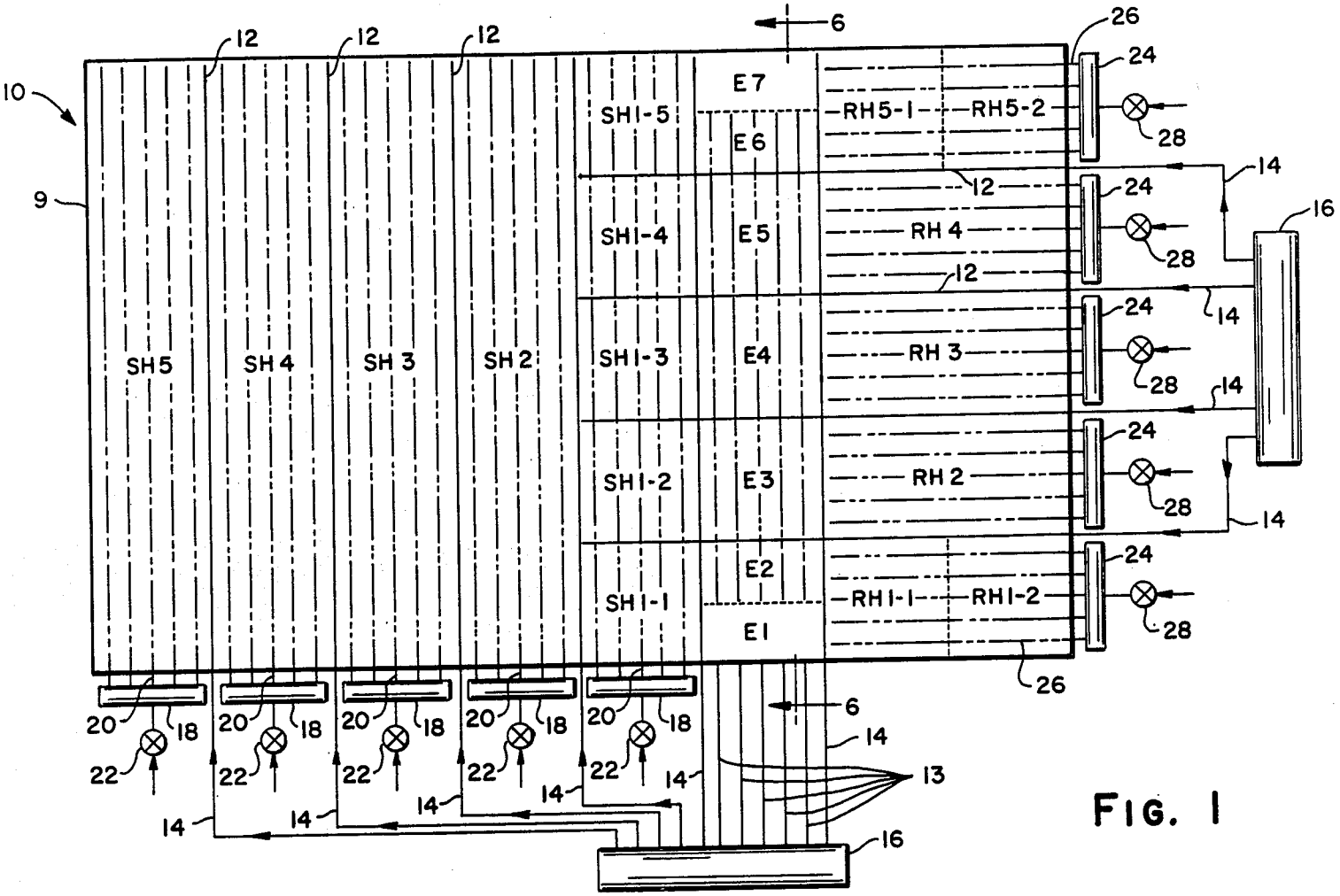
FIG. 1 is a schematic of a fluidized bed boiler incorporating the invention.
Figure 2:
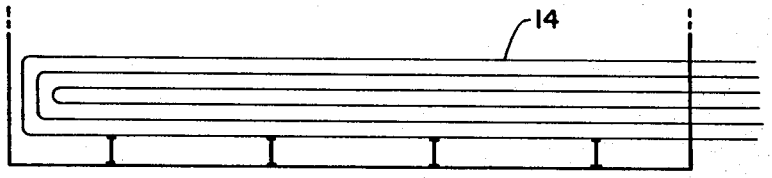
FIG. 2 shows a band of evaporator tubes which are located between each module.

Looking now to FIG. 1 of the drawings, a floor plan of a fluidized bed furnace 10 is schematically shown including a perforated grate 9. The solid lines 12 indicate the air plenum segmentation; i.e. air can be independently controlled to the separate compartments or modules within the solid lines. Air enters the bed through perforations in the bed plates. There are, as shown, five superheater sections designated SH-1, SH-2, SH-3, SH-4, and SH-5. Section SH-1 is further segmented into SH1-1 through SH1-5. There are also five reheater sections designated RH-1, RH-2, RH-3, RH-4, and RH-5. Sections RH-1 and RH-5 are further segmented into RH1-1, RH1-2, and RH5-1, RH5-2. Bands of evaporator tubing 14 are located above the center line of each major section air plenum division. They are supplied with liquid from inlet headers 16, shown at the bottom and right hand side of FIG. 1, at all times. The construction of these bands 14 is better shown in FIG. 2. The outlet header into which the fluid leaving the band flows, is not shown in FIG. 1.

Figure 3:
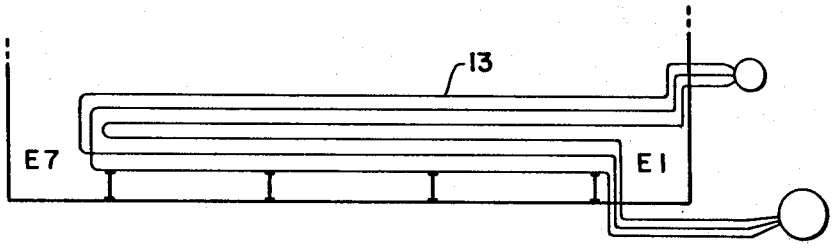
FIG. 3 shows the evaporating surface located in E-2 through E-6 of FIG. 1.

Liquid is also supplied to the bands of evaporator tubes 13 from the header 16, as shown in FIGS. 1 and 3. As shown in FIG. 3, there is no evaporator surface located in the fluidized bed sections E-1 and E-7. The purpose of this will be explained below.

Figure 4:
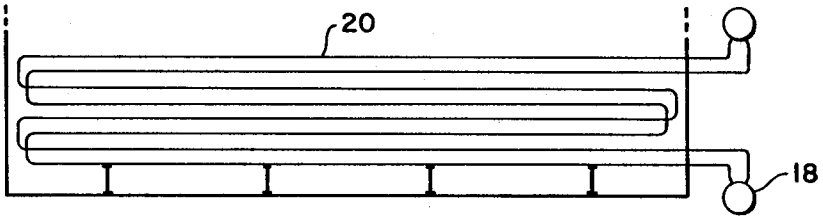
FIG. 4 shows the superheater surface SH-1 through SH-5 of FIG. 1.
Figure 5:
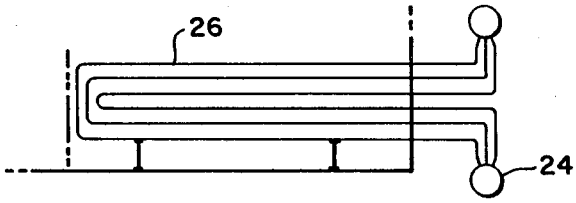
FIG. 5 shows the reheater surface RH-1 through RH-5 of FIG. 1.

Headers 18 supply steam to panels of superheater tubes 20, as shown in FIGS. 1 and 4. The flow to each individual superheater section can be independently controlled by valves 22 (FIG. 1). Likewise, headers 24 supply steam to the reheater panels 26, as shown in FIGS. 1 and 5. The flow to each individual reheater section can be independently controlled by valves 28 (FIG. 1).

Figure 6:
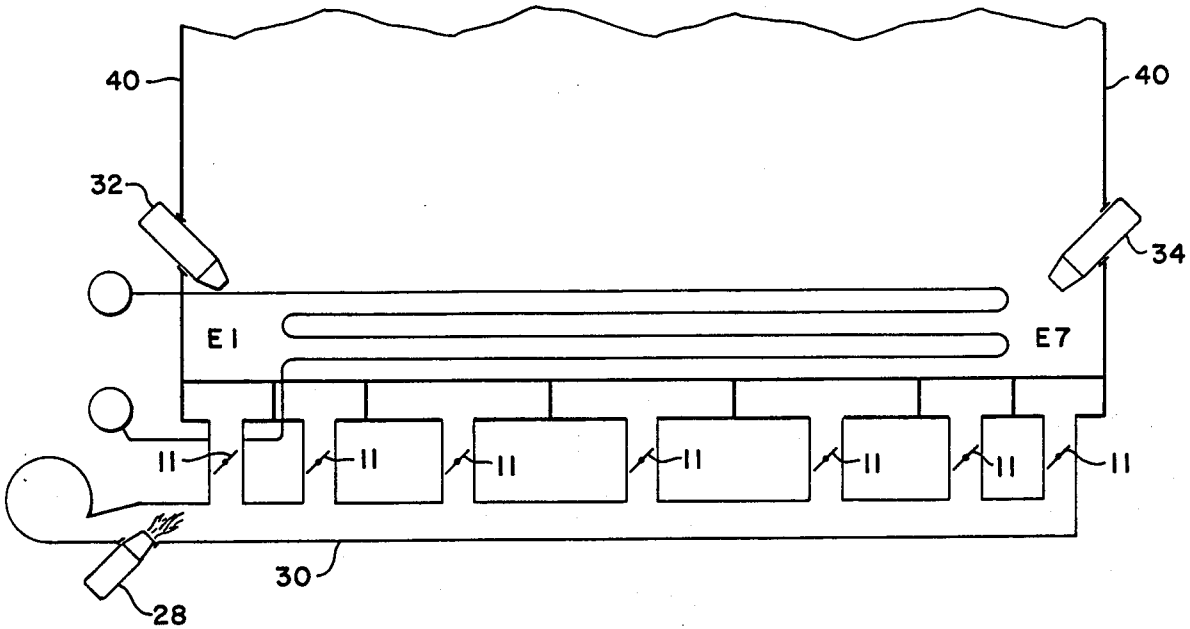
FIG. 6 is a partial cross-sectional side view of an entire fluidized bed furnace.

Looking now to FIG. 6, a burner 28 fires into the air duct 30 for preheating the fluidizing air. Startup burners 32 and 34 are located so as to fire directly into the startup zones of the fluidized bed, in the evaporator sections E-1 and E-7, shown in FIGS. 1 and 6. Dampers 11 control air flow to the various compartments or modules. As can be seen, there is no evaporator surface in either E-1 or E-7, so no heat is removed from the particulate matter during startup. This enables a faster startup to be achieved. All four walls 40 of the fluidized bed furnace are lined with evaporator tubes.

A typical startup sequence would be as follows: burner 28 in the air duct would be fired simultaneously with startup of the air fan. The dampers to section E-1 and E-7 would be opened. Fluid would be supplied to all of the evaporating surface in the bed. Burners 32 and 34 would then be fired, and coal would be supplied to the beds in modules E-1 and E-7. After these two modules are ignited, coal and air would be supplied to the adjacent evaporating, superheating, and reheating sections. The combustion of the coal can be progressively spread from one module to the next. With one full superheater and one full reheater section in operation, the combustion can be spread to full superheater and reheater sections as load demands. In part load operation with reduced steam flow, full steam flow can be valved to an appropriate number of sections. Steam outlet temperature can be varied by traditional fluid bed control methods.

The bands of evaporating surface separating adjacent superheater and adjacent reheater surface not only adds needed steam generating surface, but also performs the added function of protecting the superheater and reheater surface during startup. An inactive section of superheater or reheater surface has only a small amount of steam flow through it for protection from the radiation of the hot gases above the section. The protection from the heat flux through the bed material of an inactive section from the adjacent active section is by the evaporator surface. This surface absorbs the bed heat to protect the virtually uncooled tubing of the inactive section. Without this feature more steam flow would be required through an inactive section and would complicate the controls and lower the mixed steam temperature leaving the beds at part load. High steam temperature from the beds are required at part loads to make the steam temperatures demanded by the turbine.

I claim:

1. A fluidized bed furnace comprising a housing, a perforate grate means supported in said housing, a bed of particulate material including some combustibles supported on the grate means, said grate means being divided into a plurality of segments, means for supplying air beneath the grate means independently to each segment, burner means for directing hot combustion gases into the air being supplied to said grate means, first evaporating surface imbedded in the particulate material above first segments of the grate means, superheater surface imbedded in the particulate material above second segments of the grate means, reheater surface imbedded in the particulate material above third segments of the grate means, second evaporating surface in the form of vertical panels imbedded in the particulate material forming perforate walls separating the first evaporating surface, the superheating surface, and the reheater surface, igniter combustion means positioned so as to direct hot combustion gases into the particulate material above fourth segments of the grate means, there being no heating surface whatsoever imbedded in the particulate material above the fourth segments, so that the furnace can be quickly started up or initially fired without causing damage to any of the heating surface.

* * * * *